US007197778B2

(12) United States Patent
Sharps

(10) Patent No.: US 7,197,778 B2
(45) Date of Patent: Apr. 3, 2007

(54) PATIENT TRANSFER SYSTEM

(75) Inventor: Lewis Sharps, Bryn Mawr, PA (US)

(73) Assignee: Patient Safety Transport Systems GP, LLC, Bryn Mawr, PA (US)

( * ) Notice: Subject to any disclaimer, the term of this patent is extended or adjusted under 35 U.S.C. 154(b) by 14 days.

(21) Appl. No.: 11/294,608

(22) Filed: Nov. 19, 2005

(65) Prior Publication Data

US 2006/0075553 A1 Apr. 13, 2006

Related U.S. Application Data

(63) Continuation-in-part of application No. 10/866,852, filed on Jun. 14, 2004, now Pat. No. 6,966,081.

(51) Int. Cl.
*A61G 7/14* (2006.01)
*A61G 13/12* (2006.01)

(52) U.S. Cl. ..... 5/81.1 R; 5/86.1; 5/607; 5/621

(58) Field of Classification Search ..... 5/81.1 R, 5/86.1, 607, 608, 609, 621, 600
See application file for complete search history.

(56) References Cited

U.S. PATENT DOCUMENTS 4,658,451 A * 4/1987 Taniguchi ..... 5/607
4,840,362 A 6/1989 Bremer
4,937,901 A 7/1990 Brennan
4,939,801 A 7/1990 Schaal et al.
5,009,407 A 4/1991 Watanabe
5,088,706 A 2/1992 Jackson
5,131,106 A 7/1992 Jackson
5,239,716 A 8/1993 Fisk
6,260,220 B1 7/2001 Lamb et al.
6,324,710 B1 12/2001 Hernandez et al.
6,427,263 B1 * 8/2002 Lindell ..... 5/86.1
6,526,610 B1 3/2003 Hand et al.
6,862,761 B2 1/2004 Hand et al.
6,691,347 B2 2/2004 Hand et al.
6,718,581 B2 4/2004 Riach
6,874,181 B1 4/2005 Connolly et al.
2003/0126683 A1 7/2003 Hand et al.

FOREIGN PATENT DOCUMENTS

GB 2068850 A 8/1981

* cited by examiner

*Primary Examiner*—Alexander Grosz
(74) *Attorney, Agent, or Firm*—Werner & Axenfeld, P.C.; Robert R. Axenfeld

(57) ABSTRACT

A patient transfer system for transferring a patient to an operating table in a prone position from a supine position, and vice versa. The patient transfer system includes a chassis, a platen, and restraint/support system. The chassis has wheels secured thereto for movement of the chassis across a floor. The platen is coupled to the chassis and is rotatable about an axis. The platen is adapted to receive a patient in a supine position and rotate the patient to a prone position, and vice versa. The restraint/support system is adapted to hold the patient stationary on the platen while the patient is rotated from the supine position to the prone position, and vice versa. The restraint/support system also provides support to the head, torso, and legs of the patient when the patient is deposited on the operating table in a prone position.

21 Claims, 11 Drawing Sheets

PATIENT TRANSFER SYSTEM

CROSS-REFERENCE TO RELATED APPLICATIONS

This application is a continuation-in-part of U.S. patent application Ser. No. 10/866,852 filed on Jun. 14, 2004, now U.S. Pat. No. 6,966,081 entitled *Pivoting Transport and Positioning System for use in Hospital Operating Rooms*, which is fully incorporated herein by reference.

TECHNICAL FIELD

This invention relates generally to an apparatus for transferring a patient to and from an operating table. More particularly, this invention relates to a gurney-like device adapted for rotating a patient from a supine position (lying on the back —facing up) to a prone position (lying on the stomach—facing down), depositing the patient on an operating table in the prone position, recovering the patient from the operating table, and then rotating the patient back to the supine position.

BACKGROUND

Generally, surgeries and procedures performed to the back of a patient require the patient to be positioned in a prone position to provide access to a surgical site. Prior to performing the surgery, protocol typically requires that the patient be anesthetized and intubated while lying on their backs. For the vast majority of back surgeries performed in the United States today, most patients are still anesthetized on a gurney, and then manually lifted, inverted and deposited on an operating table.

There are many challenges associated with the transfer of the patient to the operating table from the gurney, and vice versa. The manual process of transfer is physically demanding and non-physiologic for the staff, and is potentially unsafe for the anesthetized patient. For instance, an anesthetized patient who is in an unconscious state has absolutely no control over their appendages and head, which all have a tendency to flop-down from gravity. If any appendages are not properly supported, it is possible to break, dislocate, or otherwise injure the patient's neck, shoulder area, and/or appendages while manually lifting and inverting the patient. Additionally, the patient may have a preexisting disease or injury to the spine, which if moved or twisted improperly could cause damage or paralysis to the patient. Thus, the staff must remain vigilant to properly support the appendages and body of the patient each time the patient is lifted and inverted. There is also a potential to accidentally lose control of or drop a patient incurring injury to the patient and/or staff.

Additionally, an anesthetized patient assumes "dead weight" which makes that person feel heavier. The weight of the patient exposes staff members, such as nurses, assistants, and doctors, to injuries when lifting the patient. Often times a staff member must lean across a gurney or operating room table exposing themselves to lifting injuries. Sometimes, the weight of the patient is not evenly distributed potentially risking injury to a staff member or patient. Accordingly, liability issues arise when patients are dropped or injured while being oriented on the operating table while sedated. Doctors and hospitals are also exposed to liability when operating staff are injured lifting and positioning sedated patients.

A further potential problem associated with turning the patient from his/her stomach or back involves the potential for patient motion or staff interference with life-support and life-monitoring systems that may be attached to the patient, such as an intravenous line, a catheter, electrode monitoring lines for monitoring the patient's vital signs, and an endotracheal tube for the purposes of administering oxygen and/or anesthesia to the patient. If any one of these life-support or life-monitoring systems is pulled out, crimped, or twisted, it can injure the patient and/or the operating staff.

Still another complication associated with manually lifting and inverting a patient onto an operating table for back surgery involves positioning the patient in proper alignment on the table. Some patients are placed on a Wilson Frame to properly align the back properly thereby and enhancing proper ventilation. The Wilson Frame allows the abdomen to hang pendulous and free. It is often difficult to manually manipulate the patient once placed onto the operating table to ensure proper alignment with the Wilson Frame underneath the patient.

Other ancillary problems involve positioning of the head, chest, and legs with proper support and access for devices such as the endotracheal tube. Anthropometric considerations, such as patient size, including weight and width, cause the operating staff to ensure that proper padding and elevations are used to support the head, chest, and legs. It is not uncommon to find operating staff stuffing pillows or bedding underneath a patient to adjust for different anthropometric features of a patient.

Attempts have been made to solve the manual transfer problems described above. For example, the literature had suggested using a device that traps/sandwiches a patient between sheets and numerous belt and buckle assemblies. These devices do not appear safe, because they potentially trap a patient in a cocoon in the event of a medical emergency. The many belts and buckles also appear to be cumbersome, requiring excessive and unnecessary anesthesia time to fasten and release a patient, further making these proposed devices unsafe and impractical. Furthermore, the sheets do not support the head, torso or legs of the patient once the patient is deposited on the operating table. Additionally, it is uncertain how much weight could be supported by such sheets.

One device capable of positioning the patient into a prone position from a supine position without manual lifting is known as the Jackson Spinal Surgical Table, which is a dedicated back surgery operating table. That is, back surgery is performed directly on the patient while lying on the Jackson Spinal Surgical Table. Although the Jackson Spinal Surgical Table is capable of rotating the patient to and from the supine and prone positions, the Jackson Spinal Surgical Table is not capable of transferring a patient to a conventional operating table or gurney. Nor is the Jackson Spinal Surgical Table capable of depositing a patient on or recovering a patient from a general operating table. Accordingly, once surgery is completed on the Jackson Spinal Surgical Table a patient must still be lifted and transferred from the Jackson table to a gurney or bed. Also, the Jackson table cannot be modified to accommodate a true knee-chest position.

Another drawback associated with the Jackson Spinal Surgical Table is its associated expense. Most hospitals are unable to purchase more than one or a limited number of such tables, limiting the number of back surgeries that can be performed in a hospital at any one time, as each surgery case or procedure ties-up a Jackson Spinal Surgical Table for the entire duration of the surgical case. Additionally, most hospitals are reluctant to purchase conventional operating tables as well as dedicated back surgical tables, and instead, prefer that the doctors use standard operating tables to perform back surgery. In other words, hospitals are not inclined to purchase operating table equipment that cannot be used for other procedures.

Based on the foregoing there are no adequate devices or procedures for safely transferring an anesthetized or sedated patient in the supine position from a gurney to a general operating table in the prone position for spinal surgery, for adequately restraining and supporting proper alignment of the patient for spinal surgery, or for transferring the patient back to the supine position following surgery.

SUMMARY

Briefly, the present invention is directed to a patient transfer system for transferring a patient to a standard operating table in a prone position from a supine position, and vice versa. The patient transfer system includes a mobile chassis, a platen, and restraint/support system. The chassis has wheels secured thereto for movement of the chassis across a floor. The platen is coupled to the chassis and is rotatable about an axis. The platen is adapted to receive a patient in a supine position and rotate the patient to a prone position, and vice versa. The restraint/support system is adapted to hold the patient stationary on the platen when the patient is rotated from the supine position to the prone position, and vice versa. The restraint/support system also provides support to the head, torso, and legs of the patient when the patient is deposited on the operating table in a prone position.

In another aspect of the present invention, restraint/support system includes 6 an inflatable support member that causes the spine of the prone patient to assume a 7 convex arched shape. The inflatable support member alleviates problems, such as, poor ventilation and pulmonary problems that can arise when the "dead weight" assumed by the anesthetized patient causes pressure to be exerted on the chest and abdomen. The placement of the spinal support member is adjustable when the patient is in the supine position. Once the patient is placed in a prone position over the spinal support member, the amount of inflation of the spinal support member can be adjusted so as to place the spine in the proper orientation for medical procedures such as spinal surgery.

The innovative patient transfer system described herein accommodates different anthropometric considerations, such as patient size, including weight and width. The patient transfer system is also mobile, lightweight, and easy to use. It can be operated by one or two individuals, as opposed to current manual methods of transferring a patient requiring several individuals. The patient transfer system interoperates with standard surgical tables and does not require the hospital to make further investments in tables or equipment that cannot be used for other procedures. It also allows for positioning the patient in a prone Wilson-Frame configuration or the Knee/Chest position.

The patient transfer system eliminates the need for manual lifting and rolling of patients; therefore, a potential risk of back injury to hospital staff is drastically reduced and the patient's safety is greatly improved. Furthermore, the unique restraint/support system secures the anesthetized patient, reducing the risk of dropping a patient during transfer or injuring appendages or the neck of the patient. All such safety improvements greatly lessen the risk of liability for both the surgeon and the hospital. Thus, the elegant design and function of the patient transfer system according to the present invention is more appealing to surgeons and safer for patients and hospital staff as it eliminates the need for manually lifting, inverting, and positioning of patients for delicate procedures such as neck and back surgery.

Further details and advantages of the patient transfer system will become apparent with reference to the accompanying drawings and the following detailed description.

BRIEF DESCRIPTION OF THE DRAWINGS

The detailed description is presented with reference to the accompanying figures. In the figures, the left-most digit(s) of a reference number identifies the figure in which the reference number first appears. It is emphasized that the various features in the figures are not drawn to scale, and dimensions of the various features may be arbitrarily increased or reduced for clarity of discussion.

FIG. 9B also shows an exploded view of external sidewalls.

DETAILED DESCRIPTION

Overview

This invention is directed to a patient transfer system that can receive a patient in a supine position, rotate the patient about an axis into a prone position, deposit the prone patient onto a standard operating table, support one or more portions of the patient in the prone position for spinal surgery while on an operating table surface, then recover and rotate the prone patient from the surgical table back into the supine position on the patient transfer system.

As used herein the term "operating table" refers to general operating room tables, medical procedural tables, x-ray tables, and potentially other surfaces for performing a medical procedure usually under sedation and/or general anesthesia. The term "gurney" and "gurney-like," refers to a mobile platform used in a hospital to move a patient that is lying down.

Reference herein to "one embodiment", "an embodiment", or similar formulations, means that a particular feature, structure, operation, or characteristic described in connection with the embodiment, is included in at least one embodiment of the present invention. Thus, the appearances of such phrases or formulations herein are not necessarily all referring to the same embodiment. Furthermore, various particular features, structures, procedures, or characteristics may be combined in any suitable manner in one or more embodiments.

Figure 1:
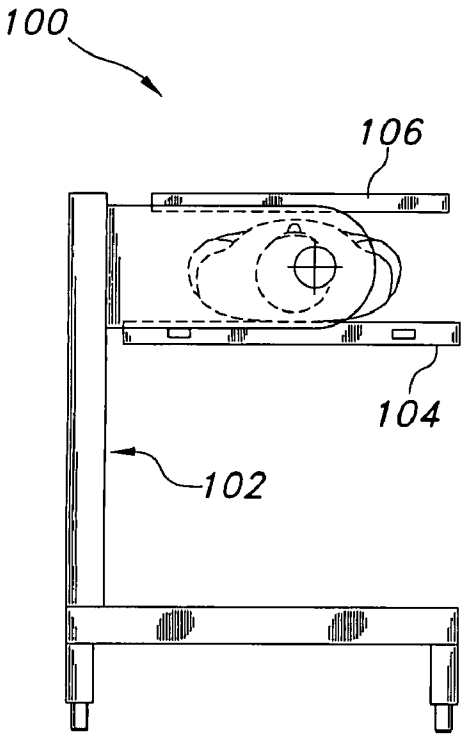
FIG. 1 is an end view of a patient transfer system with a patient secured to the system in a supine position.

Referring initially to FIG. 1 is a top end view of a patient transfer system 100 with a patient secured to the system in a supine position. Generally, the system 100 includes a chassis 102 and a platen 104, which is a patient support member for receiving a patient in a supine position. Platen 104 is rotatable about an axis for transferring the patient from a supine position to a prone position, and vice versa. A restraint/support system 106 attaches, directly or indirectly, to chassis 102 or platen 104. Restraint/support system 106 secures the patient in a stationary position when the patient is rotated from the supine position to the prone position, and vice versa.

Figure 3:
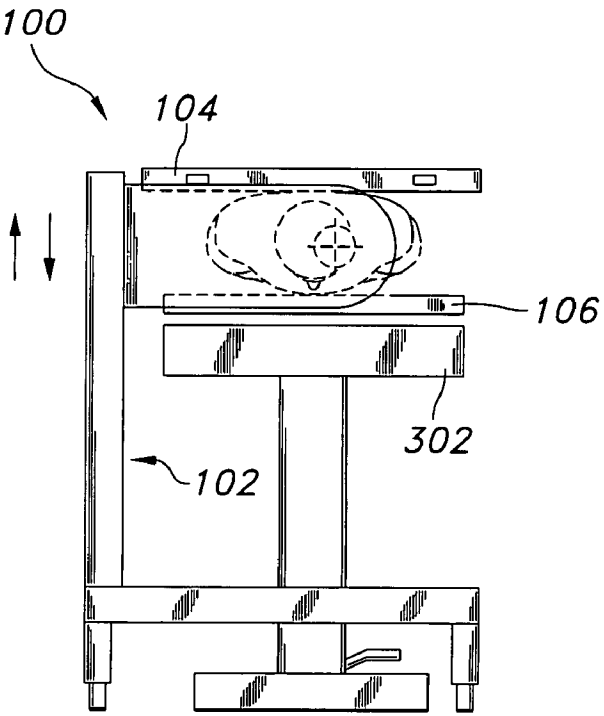
FIG. 3 is an end view of the patient transfer system with the patient positioned over a general operating table.
Figure 2:
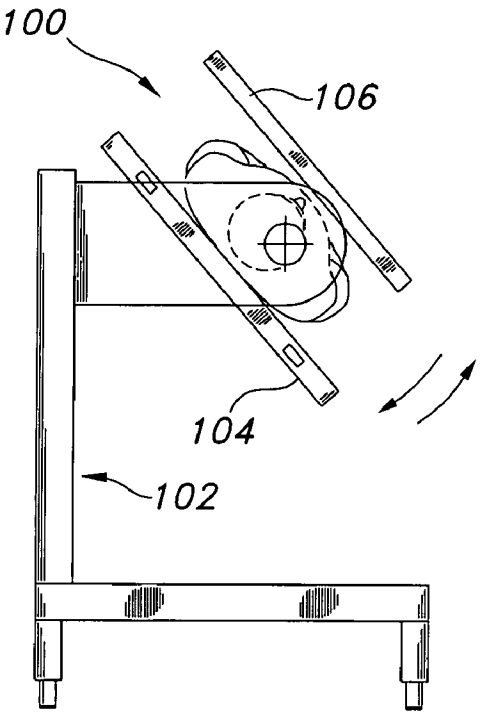
FIG. 2 is an end view showing a patient on a platen secured in a stationary position by a restraint/support system as the patient is rotated about an axis to a prone position for eventual transfer to an operating table.

For example, FIG. 2 shows a patient on platen 104 secured in a stationary position by restraint/support system 106 as the patient is rotated about an axis to a prone position for eventual transfer to an operating table. Generally, the patient is rotated 180 degrees from the supine to the prone position adjacent to the operating table. Then patient transfer system 100 is moved and aligned directly over the operating table 302 as shown in FIG. 3. Chassis 102 and/or platen 104 are height adjustable, which enables the patient to be lowered to a point when restraint/support system 106 rests on operating table 302. When the restraint/support system 106 makes contact with operating table 302, restraint/support system 106 may be detached from chassis 102 and/or platen 104, depositing the patient on operating table 302 in a prone position. One or more portions of restraint/support system 106 reside underneath the patient to elevate and support different parts of the body, such as the head and torso. Patient transfer system 100 may be wheeled away from operating table 302 and possibly used for another surgical case after the patient is deposited in the prone position on operating table 302.

To return patient to the supine position, patient transfer system 100 is moved back and aligned directly over operating table 302. Restraint/support system 106 is re-attached to chassis 102 and/or platen 104. The height adjustable chassis 102 and/or platen 104 are raised thereby inherently lifting restraint/support system 106 and the patient off operating table 302. Patient transfer system 100 may be moved away from operating room table 302 and then rotated 180 degrees from the prone position to the supine position. Patient transfer system 100 may then be used to transport the patient to a desired location, such as to a hospital room or recovery room. Restraint/support system 106 may be disengaged from chassis 102 and/or platen 104 after return of the patient to the supine position.

Having introduced patient transfer system 100, it is now possible to describe each of the constituent elements of the system in more detail.

Chassis and Platen

Figure 4:
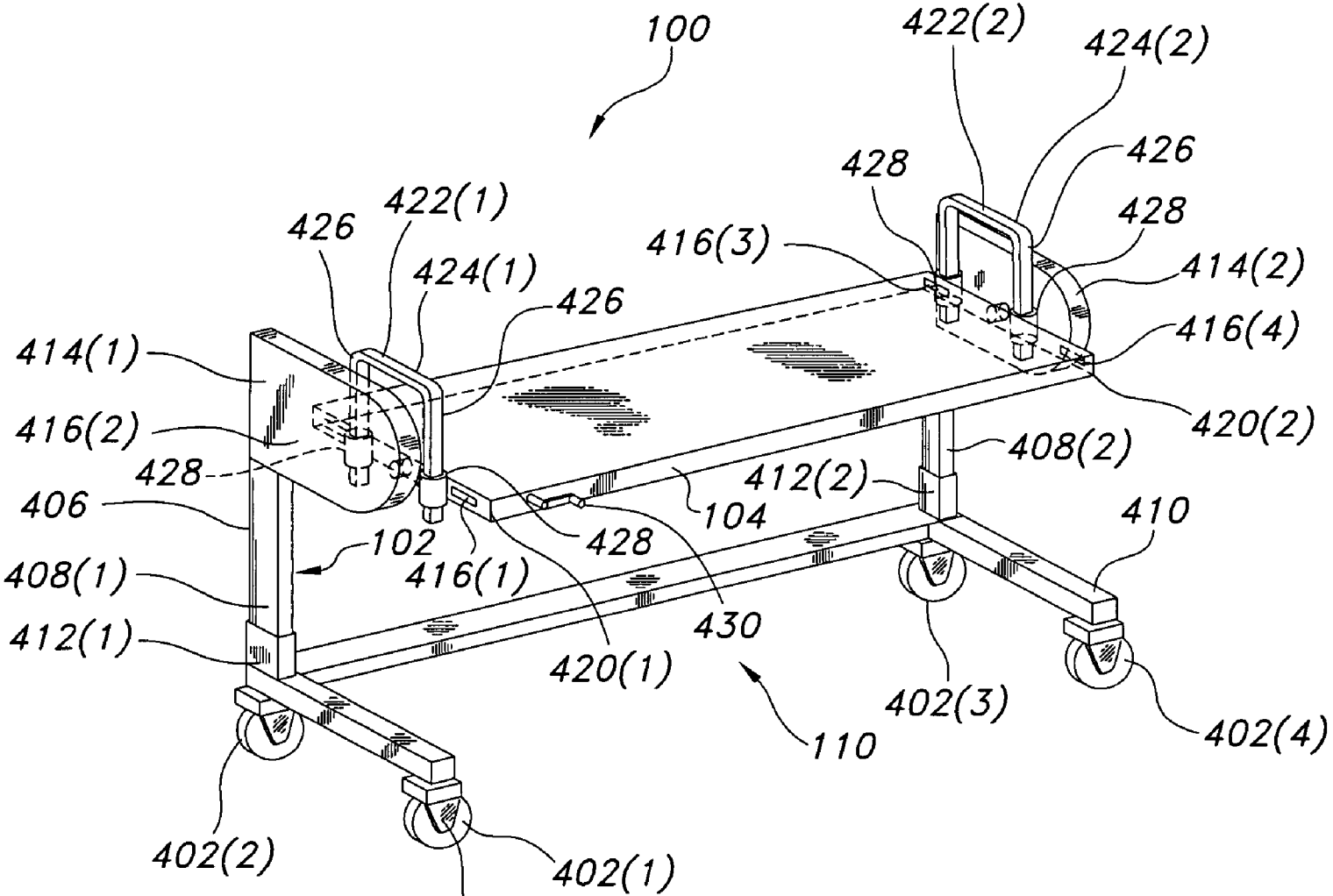
FIG. 4 is a perspective view of a patient transfer system showing the patient support area for receiving a patient in a supine position, referred to herein as the platen.

FIG. 4 is a perspective view of patient transfer system 100 showing the 11 patient support area for receiving a patient in a supine position, referred to herein as platen 104. Chassis 102 has wheels 402(1), 402(2), 402(3), 402(4) secured to the underside thereof, which maintain the chassis in spaced and parallel relation with the floor. The wheels, referred to generally as reference number 402 allow the chassis to move along the floor. The wheels allow patient transfer system 100 to be mobile and function like a gurney. Preferably, wheels 402 may have pivoting members 404, such as casters, thereby allowing maneuverability of the patient transfer system 100 about a hospital or a surgical table. Wheels 402 may also be equipped with a locking mechanism to insure that the patient transfer system 100 remains static during patient rotation and transfer (to be described). Locking mechanism may be any suitable means to secure the chassis 102 in a stationery position and prevent movement of wheels 402, such as a metal lever or brake petal.

Chassis 102 also includes a frame 406 that is configured to straddle a base of an operating table underneath platen 104 in area 110. Generally, the frame 406 has two vertical support beams 408(1) and 408(2) that extend up from a base 410 configured in a horizontal C-shaped footprint to allow the transfer system 100 to interface and straddle a base of a standard surgical table. Alternatively, base 410 of chassis 102 may have more than two vertical support beams that extend up from a horizontal footprint. Additionally, base 410 may be constructed of any suitable footprint such as shown in FIG. 1 that allows chassis 102 to align with an operating table in such fashion as to permit transfer of patient to the operating table.

In one embodiment, vertical support beams 408(1) and 408(2) of frame 406 are configured with telescoping members 412(1), 412(2), which make chassis 102 height-adjustable and allow patient transfer system 100 to move platen 104 up and down relative to an operating table surface, or other surfaces. Telescoping members 412(1) and 412(2) may move upwards and downwards relative to the base 410 of the frame 406 in order to align platen 104 with an operating table surface to deposit a patient on or remove a patient there from. Movement of telescoping members 412(1) and 412(2) may be accomplished manually, by hydraulics or other suitable lifting mechanisms. The telescoping members 412 (1) and 412(2) may include a locking mechanism (not shown) for securing the frame at the desired height. The locking mechanism may be any suitable mechanism that allows the vertical support beams 408 to remain at a set height, such as a mechanical brake and may be operated manually, electronically, by way of a foot pedal, remote control, or manual crank.

Horizontal arms 414(1) and 414(2) extending from vertical support beams 408(1) and 408(2), respectively, support platen 104. Rotation of platen 104 may occur by pushing/ pulling on handles 416(1), 416(2) 416(3), 416(4) connected on either end 420(1), 420(2) of platen 104. Alternatively, a gear and crank shaft (not shown) integrated with or attached to chassis 102 may be used to rotate platen 104 in controlled manner. Still in another embodiment, platen 104 may be rotated by power devices such as electric motors, hydraulic systems, pneumatic systems, or any suitable combination of manual and/or powered devices. Additionally, such power devices may be controlled by a remote control and/or automated control system (not shown).

Also shown in FIG. 4 at either end 420(1), 420(2) of platen 104 are U-shaped members 422(1), 422(2), which as shall be explained in more detail, provide a location for releasably attaching restraint/support system 106 to platen 104. In the exemplary embodiment, U-shaped members 422(1), 422(2) are tubular 11 bars having cross members 424(1), 424(2), respectively, which are parallel to platen 104. U-shaped members 422 also include a pair of vertical posts 426 generally perpendicular to platen 104. Vertical posts 426 fit-in and securely engage complementary shaped sleeves 428 at each end 420(1), 420(1) of platen 104.

Vertical posts 426 may be securely fixed to sleeves 428, such as by a nut and bolt. Alternatively, vertical posts 426 may move up or down within sleeves 428 permitting the relative height between cross members 424 and paten 104 to be adjusted. Adjusting the relative height between cross member 424 and platen 104 correspondingly adjusts the amount of space between platen 104 and restraint/support system 106 when restraint/support system 106 is fastened to cross members 424. Those skilled in this field having the benefit of the present disclosure will readily appreciate that there are many ways in which to achieve movement up or down of vertical posts 426 in sleeves 428. For example, vertical posts may include notches (not shown) which are engaged by teeth of a wheel located in one or more sleeves 428 which when turned by a hand crank 430 move posts 426 up or down.

Those skilled in this field having the benefit of the present disclosure will also readily appreciate that U-shaped members 422 are only one of many suitable ways for providing a mechanism to attach restraint/support system 106. For example, telescopic posts (not shown) on each corner of paten 104 could also be used in place of a U-shaped member. Additionally, a U-Shaped member of narrower dimensions could be deployed at the corners of each end 420(1), 420(2) of platen 104, instead of placing it in the center as shown in the exemplary embodiment of FIG. 4.

Figure 5:
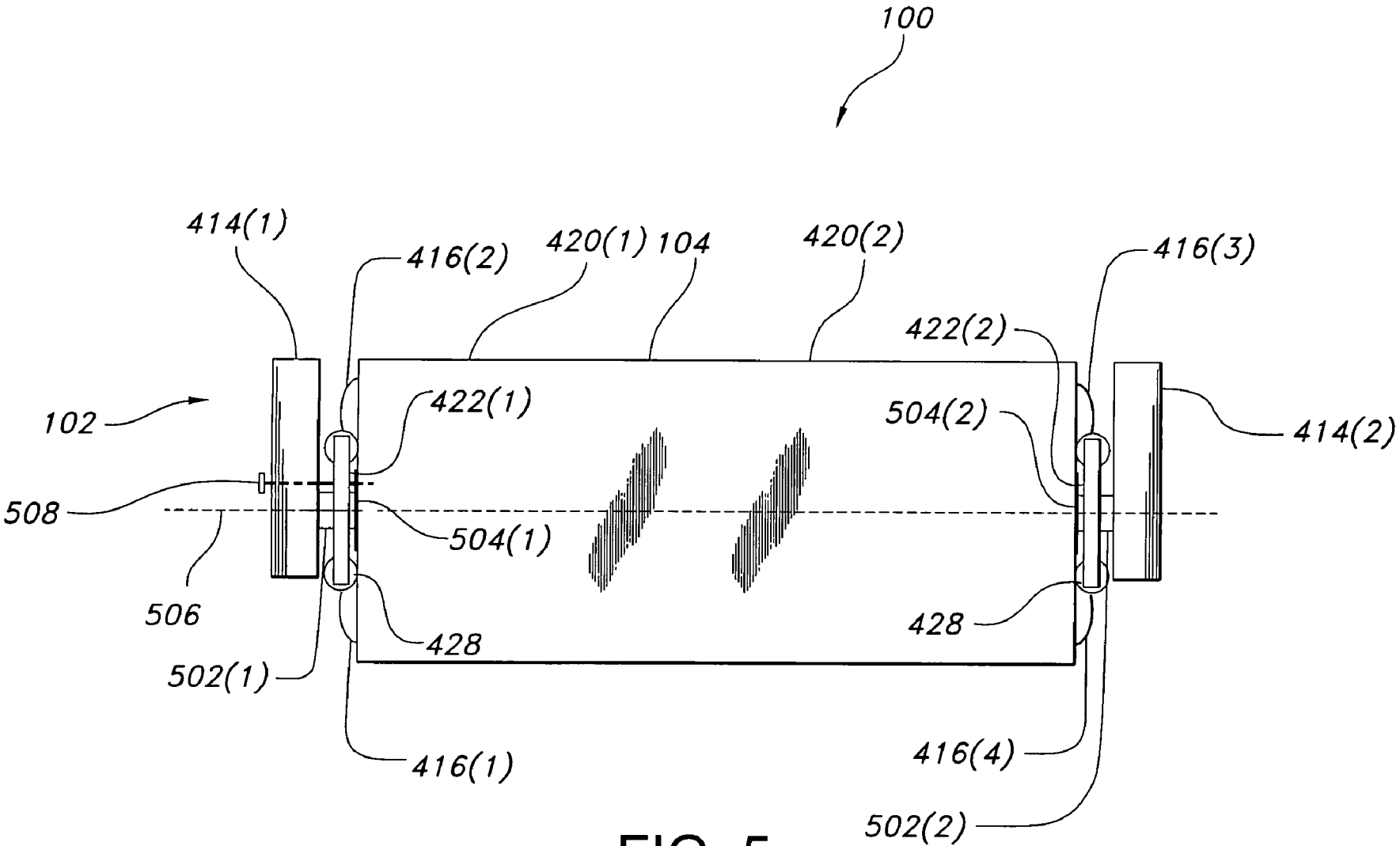
FIG. 5 is a top view of the patient transfer system showing the platen connected to the chassis of the system.

FIG. 5 is a top view of the patient transfer system showing platen 104 connected to a chassis 102. Platen 104 serves as a horizontal surface for a patient to receive pre-operative care, such as anesthesia and intra-venous fluid. At this point, platen 104 is typically locked and is secured in a horizontal position. Platen 104 is the length and width of a standard gurney. However, platen 104 could be a variety of different dimensions including narrower, wider, or longer than a standard gurney.

Platen 104 may be connected, directly or indirectly, to horizontal arms 414. In one embodiment, each end 420(1), 420(2) of platen 104 are attached to a plate 504(1), 504(2). Each plate 504(1), 504(2) is connected to rotatable members 502(1), 502(2), which facilitate rotation of platen 104 about a center axis 506 in a clockwise or counterclockwise direction. Rotatable members 502(1), 502(2) may be any suitable element, which allow rotation about an axis, such as a spindle, rod, or axle. Additionally, in alternative embodiments it is possible for platen 104 to be connected directly to a disc or similar rotation device that is integrated with horizontal arms 414.

A locking mechanism may be used to lock platen 104 in a horizontal position parallel with an operating table surface or the floor. Actuation of the locking mechanism may occur manually or through some automated control system (not shown). It is appreciated that many suitable locking mechanisms could be used in conjunction with patient transfer system 100 to allow platen 104 to rotate freely or to secure platen 104 in a fixed position. Such devices may include brakes, gears, magnets, and various other automated and manually operated locking mechanisms.

In the embodiment of FIG. 5 the locking mechanism is implemented as a pin 508 positioned to engage a receiving aperture (not shown) in plate 504(1) when the platen is to be locked in a horizontal position. To rotate platen 104, pin 508 is disengaged from aperture (not shown). Movement of pin 508 may be accomplished manually or through some mechanical interaction with pin 508 via a switch, automatic control system, remote control, or other suitable control systems. Pin 508 may also be resiliently biased by a spring. More than one aperture may be provided in plate 504(1) to enable pin 508 to engage and lock platen 104 in a fixed horizontal position parallel with the floor, such as when rotating the patient from a first locked position (patient in a supine position) to a second locked position (patient in a prone position). Additionally, optional indicators in communication with the locking mechanism may be used to indicate when platen 104 is in a fixed and secure position, such as when a patient is embarking or disembarking platen 104.

Additionally, an interlock mechanism system could also be included with patient transfer system 100 that prevents disengagement of the patient support/restraint system 106 except when platen is in a supine or prone orientation.

Although platen 104 is generally shown as being rotated about center axis 506 herein, it is also possible to rotate platen 104 about an off-center axis in an alternative embodiment. When rotating a patient about an off-center axis it may be necessary to use outrigger legs to stabilize chassis 102.

Restraint/Support System,

Having described chassis 102 and platen 104, it is now possible to describe the restraint and support system (restraint/support system) 106, used to hold a patient including his appendages, neck, head, and spine, in a stationary position while he/she is rotated from a supine position to a prone position, and vice versa. Restraint/support system 106 also provides support under and around the patient when rotated from the supine position to prone position, and vice versa. Restraint/support system 106 also provides support underneath the patient while the patient is in the prone position, such as lying prone on an operating room table during a medical procedure.

Figure 6A:
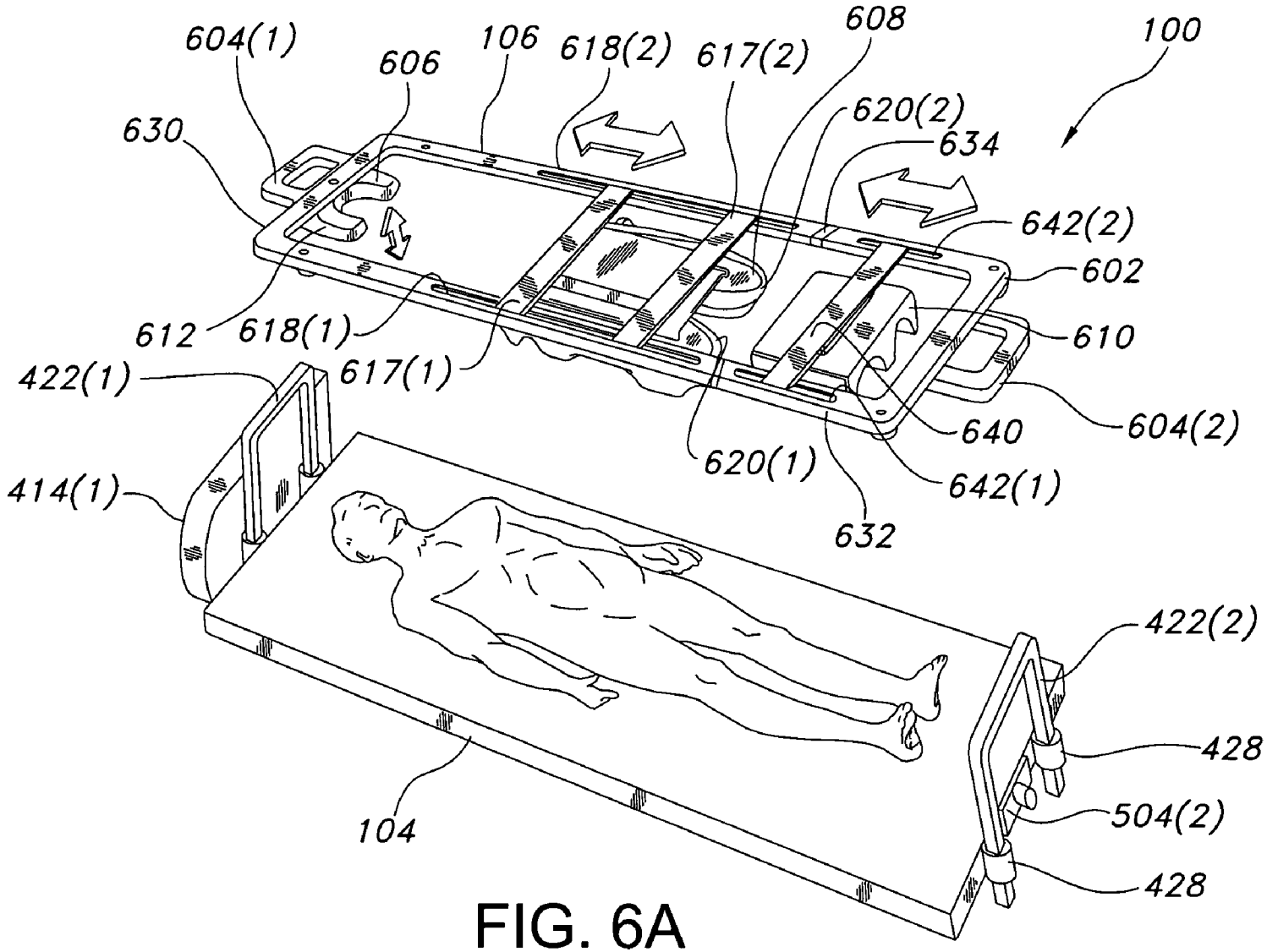
FIG. 6A shows a perspective view of an exemplary restraint/support system 106 in an exploded view with respect to the platen.

FIG. 6A shows a perspective view of an exemplary restraint/support system 106 in an exploded view with respect to platen 104. Restraint/support system 106 is configured to attach to platen 104 and/or chassis 102, and fit over and encase a patient lying in a supine position on platen 104.

Frame for Restraint/Support System

Restraint/support system 106 includes a frame 602 having a generally rectangular shape with a width and length commensurate with the surface of most operating tables. Accordingly, frame 602 is narrower than platen 104. In alterative embodiments, however, frame 602 may be of other sizes, such as wider than the surface of an operating room table. Frame 602 may be constructed of a light weight rigid material, such as carbon composite, and may be radiolucent. Integrated handles 604(1), 604(2) are located at opposite ends of frame 602, to enable staff members at opposite ends to position frame 602 over a patient or remove frame 602 from a patient.

Frame 602 may also include subsections that are disengageable from each other. For instance, referring to FIGS. 6A and 6B, a subsection 630 of frame 602 is attached to a subsection 632 of frame 602 at a location 634. Location 634 corresponds to a section of the operating table that separates into two different levels. Accordingly, subsection 632 of frame 602 may be disengaged from subsection 630 prior to lowering a section of the operating table. Subsection 632 of frame 602 may be reattached to subsection 630, after the operating table is raised to its original position. Either subsection may have tapered tubing 635 (FIG. 6B) at location 634 that slides inside the other subsection, such as into tubes 637 (FIG. 6B) of frame 602 in a concentric manner. Pins 639 (FIG. 6B) may engage holes 641 (FIG. 6B) in the tubing to connect the two subsections together (e.g., 630, and 632). It is readily appreciated that other mechanisms may be used to connect the two subsections together.

Figure 6B:
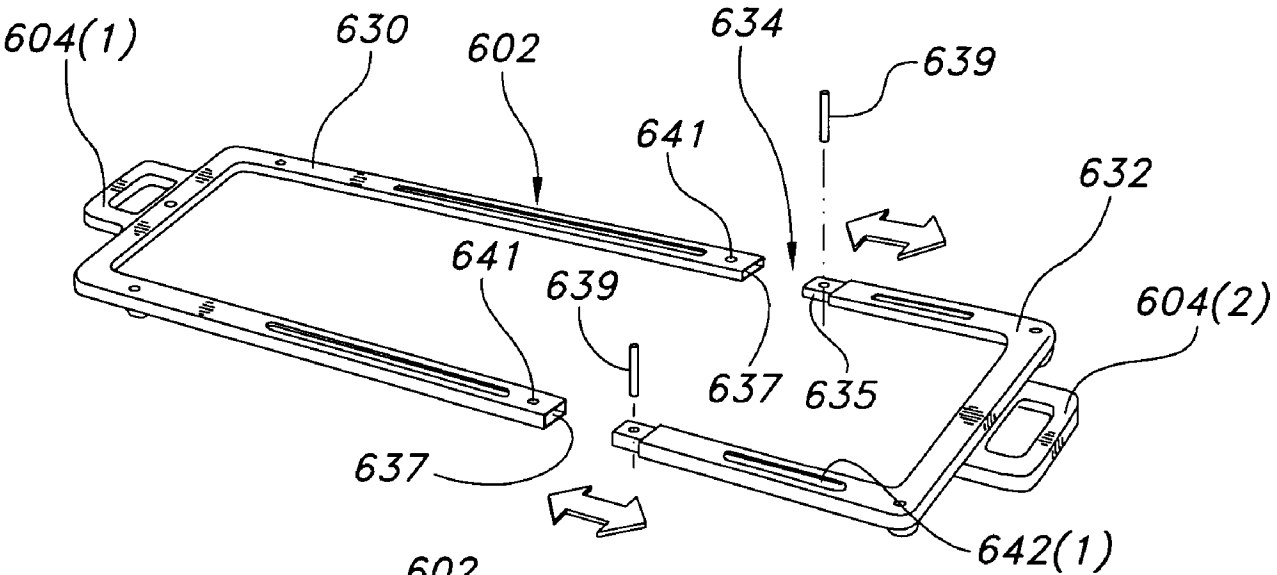
FIG. 6B shows a perspective view of a frame for the restraint/support system having two subsections.
Figure 6C:
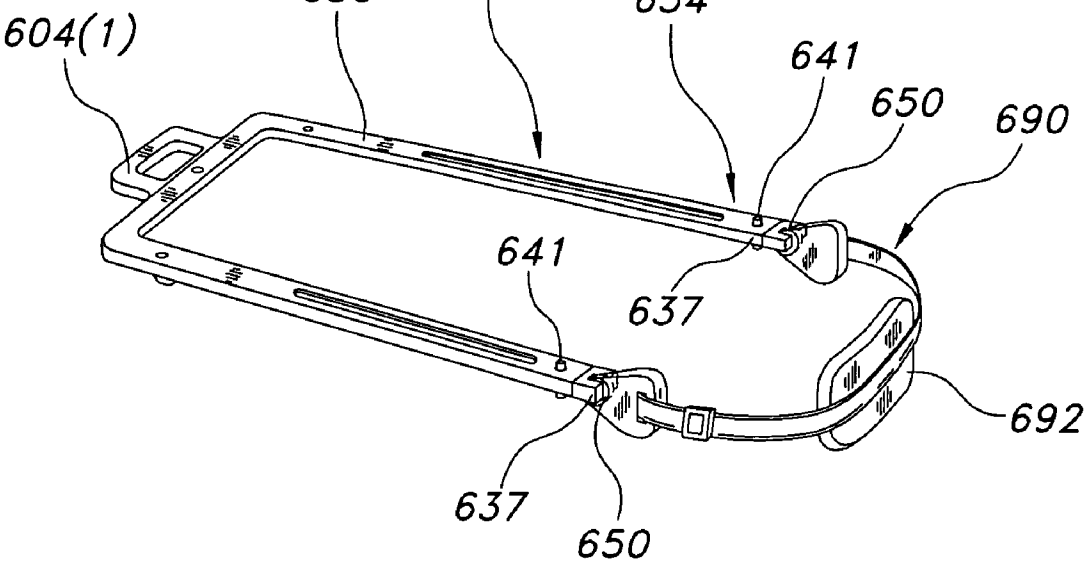
FIG. 6C shows a perspective view a subsection of the frame (shown in FIG. 6B), having a buttocks support member attached thereto.

Additionally, after subsections 630 and 632 disengage it is possible to connect a buttocks support member 690 to subsection 630 as shown in FIG. 6C. A buttock support member 690 wraps around the buttocks of a patient, at a location 692, and secures the patient to subsection 630 of frame 602 while the patient is in a knee-to-chest position or similarly situated position (see also FIG. 13). Buttocks support member 690 may include a solid frame and/or flexible straps with connection members that engage subsection 630 (such as tapered tubing engaging inside tubes 637 in a concentric manner as shown in FIG. 6B). As shown in FIG. 6C, pins 650 allow buttocks support member 690 to pivot up and down to accommodate different sized patients and their positioning when in a knee-chest position on an operating table.

Referring back to FIG. 6A, restraint/support system 602 also includes segmented support members such as a head support member 606, a torso support member 608, and a leg support member 610.

Exemplary Head Support for Restraint/Support System

Head support member 606, torso support member 608, and leg support member 610 are arranged as an assembly to secure the head, torso, and legs of the patient, respectively, for transfer from the supine position to the prone position, and vice versa. The restraint/support members may be disposable or reusable.

Each support member includes support padding contoured to correspond with the anatomy which they support and restrain. In one embodiment, head support member 606, torso support member 608, and leg support member 610, are contoured to restrain/support the head, chest area, and legs, respectively. In other embodiments, additional areas of the anatomy may have contoured padding for restraint/support such as the hips, knees, and feet. Also, it is possible to remove support members such as eliminating padding support around the leg area when the patient is resting on an operating table surface.

Exemplary embodiments of each of the support members shall now be described in more detail. Head support member 606 is contoured to support, elevate and cradle the outer portions of the face and head of a patient. Additionally, head support member 606 is contoured to restrain and provide lateral support to the head and neck of the patient during transfer. In one embodiment head support member 606 is constructed of layered resilient material, such as foam rubber, gel material, or other suitable materials. Alternatively, head support member 606 may be constructed as a single unitary member that comes in different sizes such as adult or pediatric sized members. Additionally, head support member 606 may have an inflation bladder (not shown) to receive pressured air or fluid to adjust the size of head support member 606. Additionally, head support member 606 may rotate in a horizontal direction and/or move in an upward or downward direction perpendicular to platen 104 to ensure head support member 606 is lowered far enough to restrain and support the head/neck of the patient during transfer. This may be accomplished through the aforementioned inflation/deflation mechanism or by other means such as a pneumatic piston, crank and ratchet system, or other suitable mechanisms.

Head support member 606 attaches to frame 602 via a fastening mechanism, such as Velcro, adhesive, latches, screws, or any other suitable fastening devices or combinations of such devices. Head support member 606 may also attach to a plate (not shown) which is integral with or attached to frame 602. Alternatively, head support member 606 may be disposed between a cross member (not shown) and frame 602. In another embodiment (not shown), head support member 606 may be attached to frame 602 by straps that wrap around frame 602 that allow head support member 606 to slide up and down frame 602 to adjust for different patient axial positioning of the head on platen 104.

Figure 7:
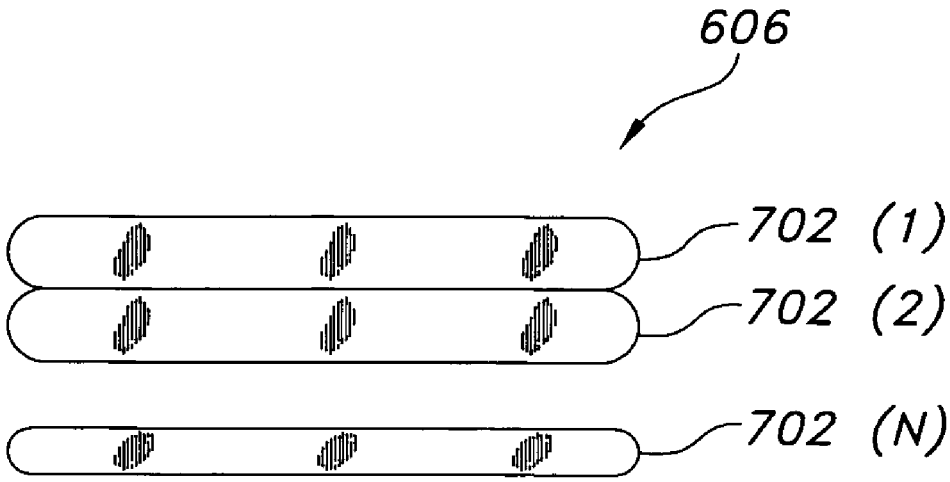
FIG. 7 shows a side view of a head support member, including multiple pads that may be inserted between the frame of the restraint support system and the patient's head/face.

FIG. 7 shows a side view of head support member 606 (FIG. 6A), including multiple pads 702(1), 702(2), . . . , 702(N) that may be inserted between frame 602 (or a cross member, or plate, etc.) and the patient's head/face. Multiple pads 702 are inserted between frame 602 (FIG. 6A) and the front of the patient's head preferably eliminating gaps between the front of the head and head support member 606 (FIG. 6A) when the patient is resting on platen 104 in the supine position. Filling the void with multiple pads prevents the patient's head from falling forward or sliding laterally when the patient is rotated about the axis.

Accordingly, adding pads, referred to generally as reference number 702, increases the overall height of head support member 606 (FIG. 6A), and also increases the elevation of the head in relation to the operating table when the patient is placed in the prone position during a medical procedure. Whereas, eliminating pads 702 decreases the overall height of head support member 606 (FIG. 6A), and decreases the elevation of the head in relation to the operating table surface. Each pad may be connected to the other by fastening mechanisms, such as peel-away adhesive, Velcro, post and grooves, or other suitable fastening techniques. Each pad may be disposable or reusable.

In another embodiment, a single unitary member may be used instead of a layered padding approach. In this approach, head support member 606 (FIG. 6A) may be inflated or deflated by air and/or liquid to increase or decrease the height of head support member 606.

Figure 8:
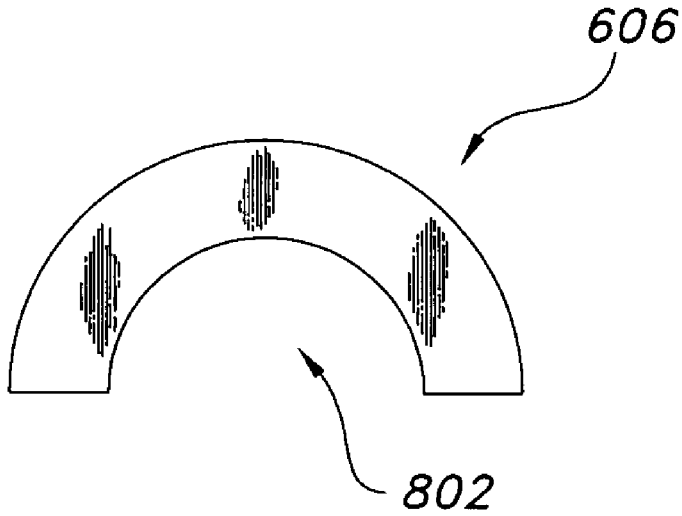
FIG. 8 is a top view of an embodiment of the head support member.

FIG. 8 is a top view of head support member 606 (FIG. 6A). According to this embodiment, head support member 606 (FIG. 6A) is contoured to abut the exterior portions of the patient's head and face. An opening 802 corresponding to the mouth and nose area is provided so as not to interfere with ventilation or airway tubes.

Exemplary Torso Support for Restraint/Support System

Referring back to FIG. 6A, restraint/support system 106 further includes a torso support member 608 (also referred to as a spinal support member). Different types of interchangeable torso support members may be included as part of restraint/support member 106, for instance, for those physicians that prefer a Wilson Frame styled support member underneath the chest area of a prone patient on the operating table. Such a torso support member 608 may include an integrated arching support system, to adjust the amount of convexity associated with torso support member 608 (see e.g., FIGS. 9A and 9B). This integrated arching support system may assist the physician in placing the spine in a proper convex orientation for medical procedures such as spinal surgery.

The arching support system may place the torso support member 608 into a convex shape using one or more inflation bladders (also referred to as chambers) that may inflate or deflate by pressured air or fluid. Arching support system may adjust the convexity of torso support member 608 by way of a mechanical crank system similar to those used with dedicated Wilson Frame support systems. The adjustability of padding associated with torso support member 608 alleviates problems, such as, poor ventilation and pulmonary problems that can arise when "dead weight" assumed by the anesthetized patient causes pressure to be exerted on the chest and abdomen.

Physicians that prefer a knee-chest position may use a torso support member 608 with static padding that supports the upper chest. In either scenario, torso support member 608 includes padding configured to support and secure the upper and outer portions of a patient's chest while the patient is rotated from supine to prone position, and back, as well as while lying in a prone position. For example, torso support member 608 may include padding contoured to provide lateral support on the sides of the chest during patient rotation. The padding may also be contoured to elevate the outer portions of the chest and to relieve pressure on the abdomen during surgery.

In one embodiment, torso support member 608 is removably mounted to cross members 617(1), 617(2) as shown in FIG. 6A. Each cross member 617 is connected to a track 618(1), 618(2) (FIG. 6A), which permits the cross members 617 to slide up and down frame 602 in a lengthwise direction to accommodate different sizes and heights of patients. The width of torso support member 608 may also be adjustable to accommodate varying sizes of patients. For example, each outer portion 620(1), 620(2) of torso support member 608 may slide to make outer portions 620(1), 620(2) wider or narrower to accommodate for varying patient dimensions. Alternatively, to accommodate different dimensions, different sized pads may be selected that are commensurate in size of the patient.

Figure 9A:
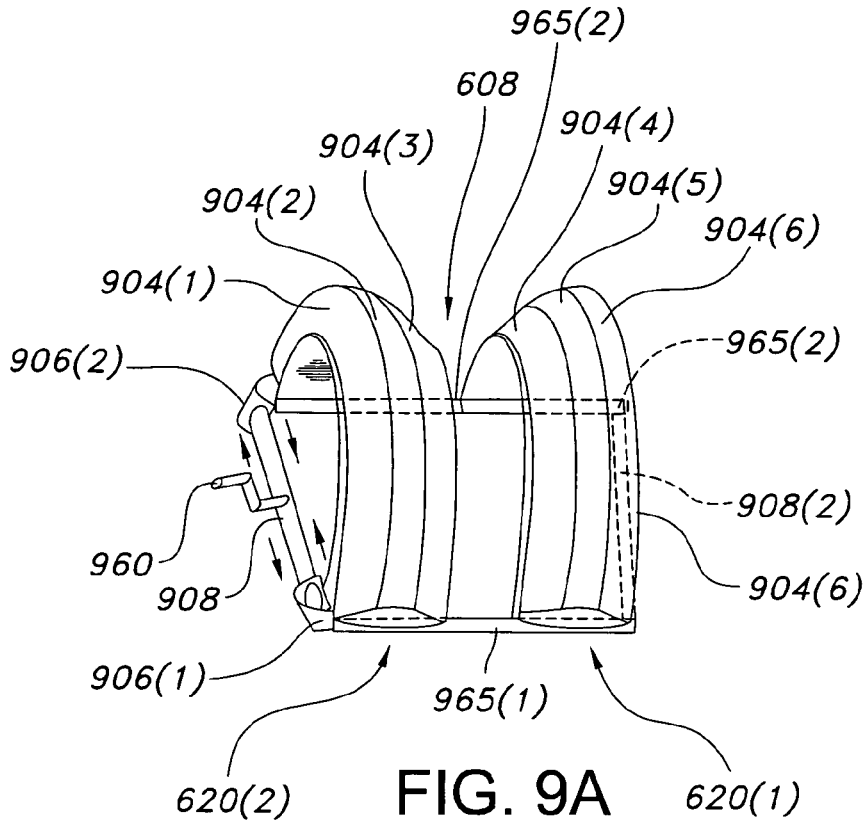
FIG. 9A shows an obverse view of a portion of the torso support member shown in FIG. 6A.
Figure 9B:
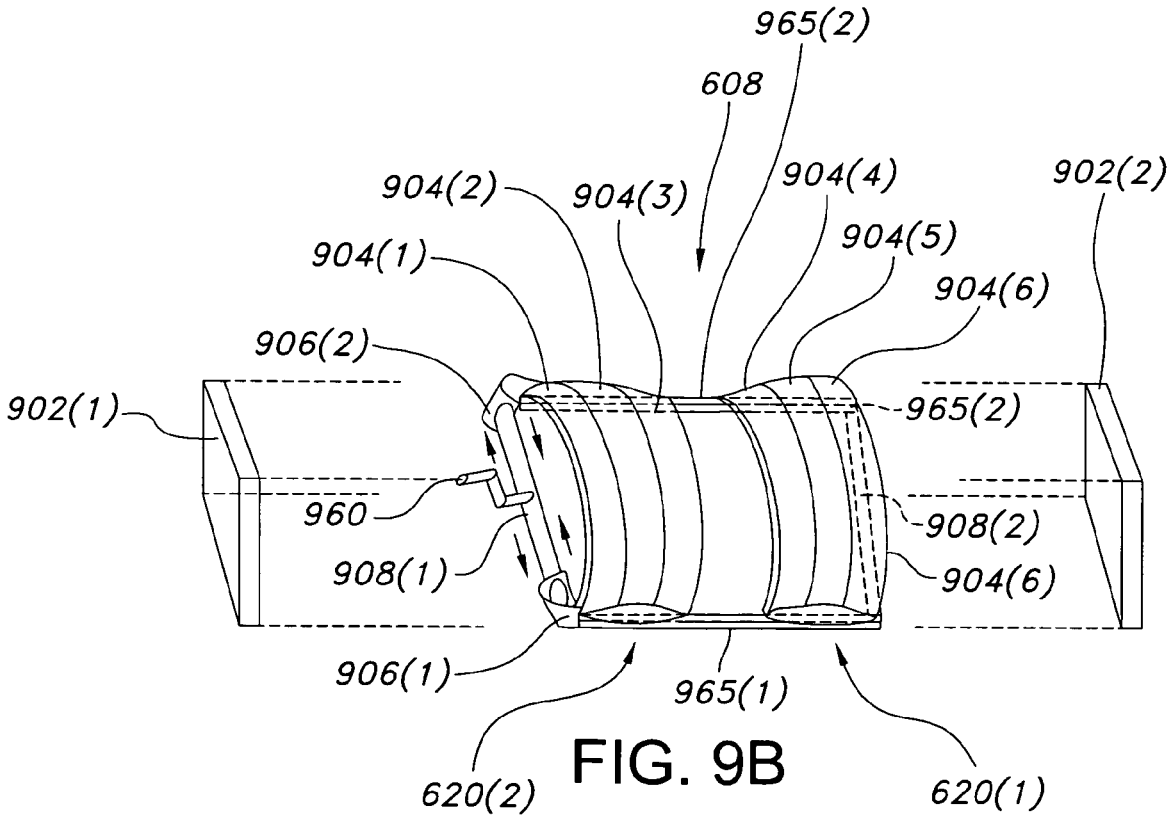
FIG. 9B is identical to FIG. 9A, but shows the torso support member lowered into a less convex shape.
Figure 12:
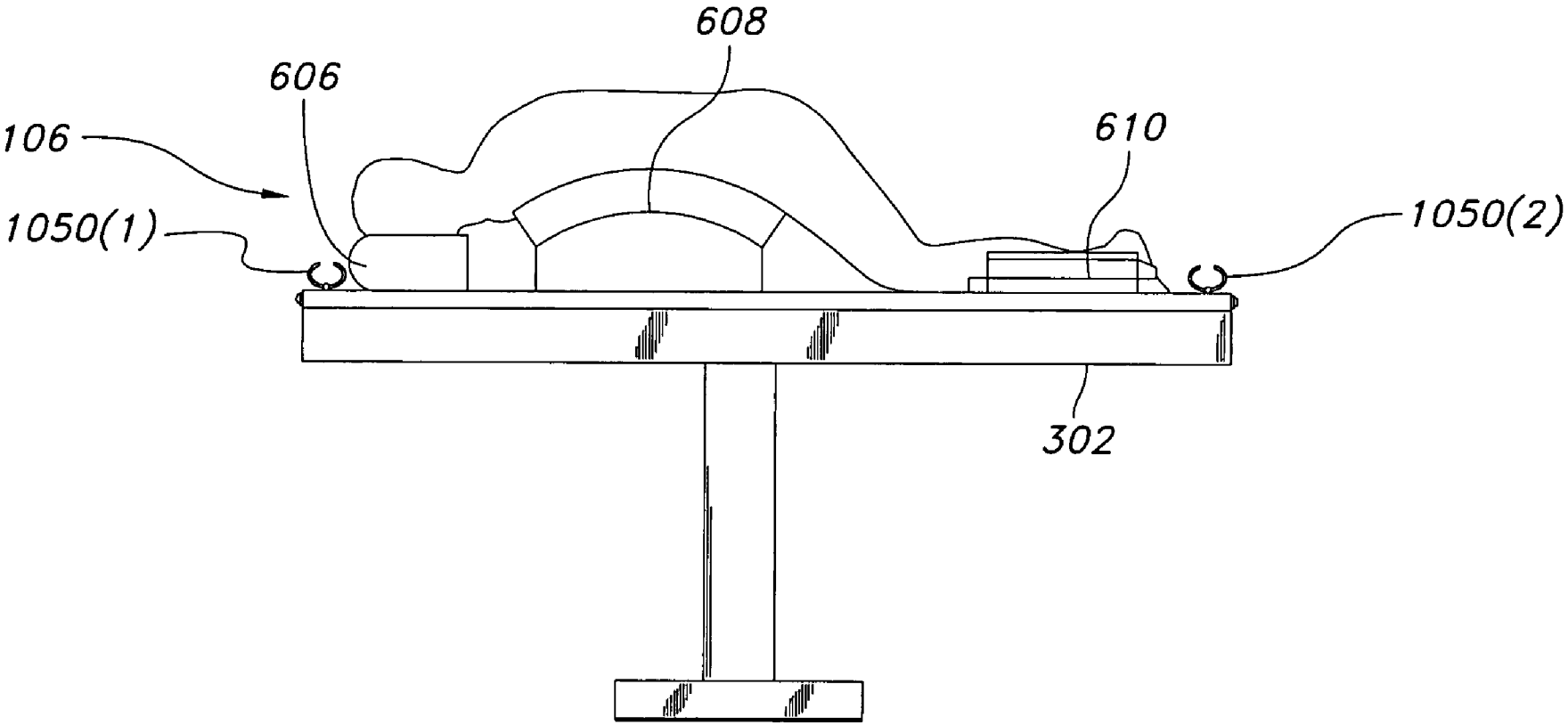
FIG. 12 shows a side view of a patient disposed in a prone position on an operating table with the restraint/support system residing underneath the patient, elevating and supporting the head, torso, and the legs of the patient, respectively.

FIG. 9A shows an obverse view of a portion of the torso support member shown in FIG. 6A. In the exemplary embodiment of FIG. 9A torso support member 608 is implemented in what is commonly referred to as a Wilson Frame configuration. Each outer portion 620(1), 620(2) of torso support member is contoured to abut and fit against the outer portions of the patient's chest and/or pelvis. In between outer portions 620(1), 620(2) is open space to allow the abdomen of the patient to hang free. Accordingly, each outer portion 620(1), 620(2) is configured to support at least the rib cage and possibly the iliac crests of the patient. Each outer portions 620(1), 620(2) at its center, is height adjustable forming a convex shape when raised as shown in FIG. 9A, and flattening in shape when lowered as shown in FIG. 9B (see also FIG. 10). When outer portions 620(1), 620(2) are raised they assume a convex shape, which when residing underneath a patient on an operating table, causes the spine of the patient to assume a convex arched shape (as shown in FIG. 12). When lowered they may have a less pronounced or flat appearance, which when residing underneath a patient on an operating table, cause the spine of a patient to assume a flatter state.

Referring to FIG. 9A, the cross members 965(1), 965(2) are connected by two mechanical screws 908(1), 908(2). When a crank 960 is turned in one direction, it causes the screws 908(1), 908(2) to shorten in length and pull each end 906(1), 906(2) of outer portions 620(1), 620(2) toward each other. When crank 960 is turned in the opposite direction, it causes the screws 908(1), 908(2) to extend in length and push each end 906(1), 906(2) away from each other, thereby flattening outer portions 620(1), 620(2).

It will be appreciated by those skilled in this field and having the benefit of the present disclosure, outer portions 620(1), 620(2) may assume a convex shape as a result of adjusting one of several types of arching support systems other than one or more screws 908, such as by using inflatable chambers, a spring and/or crank system, or other suitable mechanisms.

In one embodiment, outer portions 620(1), 620(2) may be made out of cushioned material such as gel pads, or foam. Alternatively, as shown in the exemplary embodiment in FIGS. 9A and 9B, outer portions 620(1), 620(2), include three longitudinally extending air chambers 904(6), 904(5), 904(4), and 904(3), 904(2), 904(1), respectively, for supporting each side of the patient's chest. Chambers, referred to generally as reference number 904, may expand via pneumatic (compressed air) control, or hydraulic control (i.e., liquid). An electronic controller, such as a computer, may control the actuation of air or liquid into the chambers.

When fully inflated or filled, each chamber 904 assumes a convex shape, which when residing underneath a patient on an operating table, causes the spine of the patient to assume a convex arched shape (see also torso support member 608 in FIG. 12). Referring to FIG. 9A, each chamber 904 may be individually inflated to accommodate different sized patients. For example, for a heavier and larger patient it may be necessary to fully inflate each chamber 904, whereas for a lighter and smaller patient, it may only be necessary to partially inflate chambers 904 or leave them deflated.

It will be appreciated by those skilled in this field and having the benefit of the present disclosure, that the number, orientation, and shape of chambers 904 is a matter of choice and thus the specific number and arrangement shown is merely exemplary.

FIG. 9B is identical to FIG. 9A, but shows torso support member 608 lowered into a less convex shape. This is accomplished by extending the length of screws 908 via crank 960 and/or by deflating chambers 904. FIG. 9B also shows an exploded view of external sidewalls 902(1), and 902(2). External sidewalls 902(1) are fastened (fixed or releasably) to cross members 965(1), 965(2) and/or other elements of torso support member 608. External sidewalls 902(1), 902(2) provide lateral support to the patient when rotated from supine to prone position, and vice versa. That is, when outer portions 620(1), 620(2), are generally extended and flattened in shape allowing the patient's spine to assume a less convex shape each external side wall, referred to generally as reference number 902 cradles the patient while rotated 180 degrees from supine to prone position or vice versa. Lateral support members 902 may comprise a frame (not shown) encased within padding or may also be adjustable in size, such as by inflatable mechanisms. Additionally, the size and shape of external sidewalls 902 may be selectable to correspond with different sized patients.

For clarity it should be noted again that each outer portion 620(1), 620(2) of torso support member 608 may slide along cross member 965(1), 965(2) via tracks (not shown) to make outer portions 620(1), 620(2) wider or narrower to accommodate for varying patient dimensions.

Figure 10:
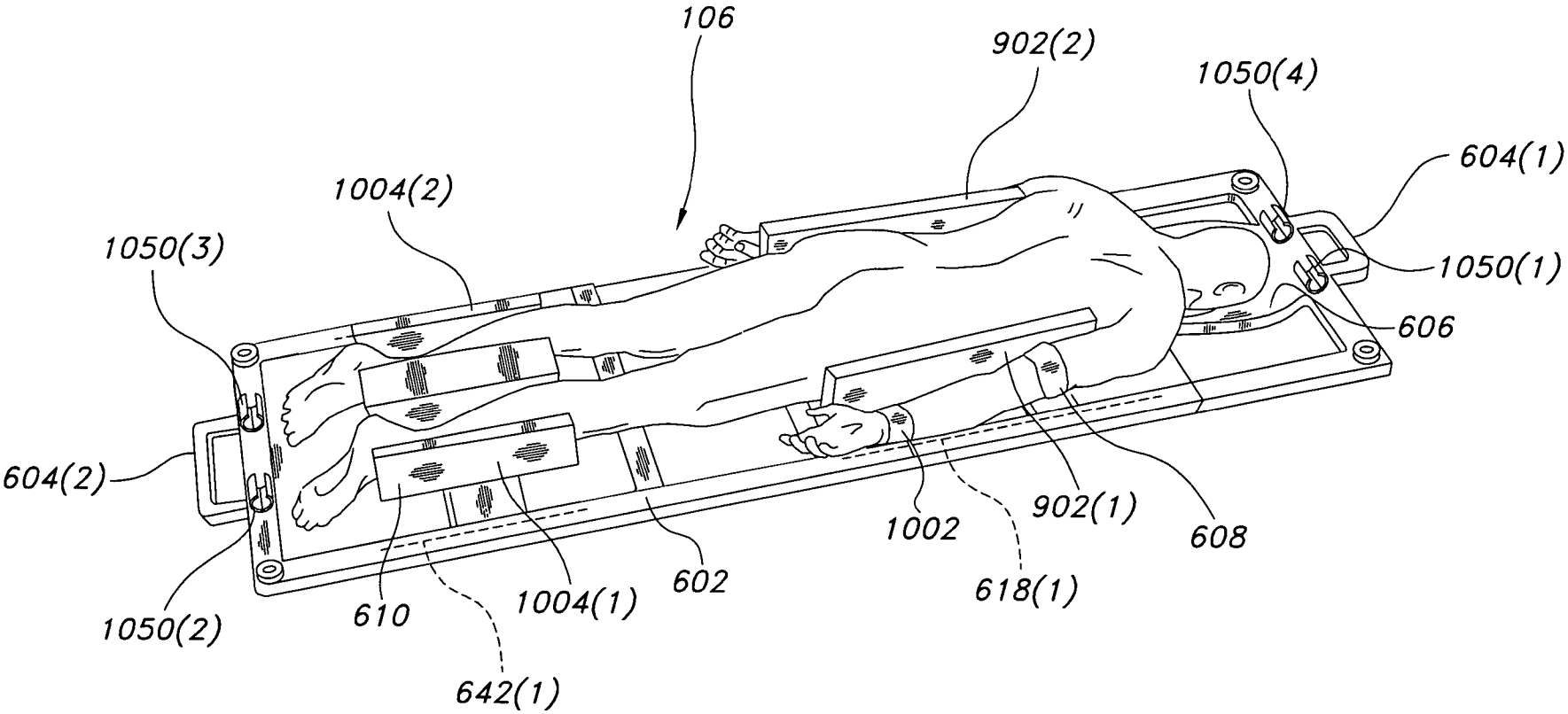
FIG. 10 shows a perspective view of a patient in a prone position with the restraint/support system residing underneath the patient.

FIG. 10 shows a perspective view of a patient in a prone position with restraint/support system 106 residing underneath the patient. As shown therein, external sidewalls 902 of torso support member 608 provide lateral support to the patient when rotated from supine to prone position and vice versa. Additionally, arm straps 1002 are provided that secure the arms to torso support member 608 while the patient is rotated 180 degrees from either the prone or supine position. Arm straps 1002 may attach to torso support member 608 by a fastening device, such as Velcro, snaps, or other suitable fastening mechanisms.

Exemplary Leg Support for Restraint/Support System

Also shown in FIG. 10, are pads 1004(1) and 1004(2) of leg support member 610. Each pad 1004 is contoured to encircle the outer portions of the patient's legs thereby providing lateral support to the legs when the patient is rotated 180 degrees from either the prone or supine position. Additionally, pads 1004 provide a cushioned barrier between the operating table surface and the legs of the patient. Pads 1004 may also support the knees and shins if the patient is placed into the knee-chest position on the operating table and can be adjusted to flex the patient's knees. For example, it is possible for pads 1004 to inflate causing pads 1004 to rise, which flexes the patient's knees when in a knee-chest position.

Referring now to FIGS. 6A and 10, leg support member 610 is removably mounted to cross member 640. In turn, cross member 640 is connected to tracks 642(1), 642(2), which permit cross member 640 to slide up and down frame 602 in a lengthwise direction to enable leg support member 610 to accommodate different lengths of patient's legs and relative positioning of the patient on platen 104.

Methods of Operation

Having described exemplary embodiments of patient transfer system 100 above, it is now possible to describe methods of connecting/disconnecting restraint/support system 106 and operating patient transfer system 100.

Referring to FIG. 10, at each end of frame 602 are clamps 1050(1), 1050(2), 1050(3), 1050(4), each configured to fit around respective portion of a cross member 424 (FIG. 4) in a concentric manner. Each clamp 1050 includes a turn buckle (not shown) which when fastened locks the clamp in closed position, such as around cross member 424. More or less clamps may be used in alterative embodiments than is shown in FIG. 10. Additionally, it will be appreciated by those skilled in this field and having the benefit of the present disclosure, that different fastening mechanisms other than clamps 1050 may be used to secure restraint/support system 106 to platen 104 (or chassis 102), such as magnets, thread/bolt technology, locking pins, clips, hooks, combinations or variations of the aforementioned, or by other suitable connection engagement mechanisms.

Figure 11:
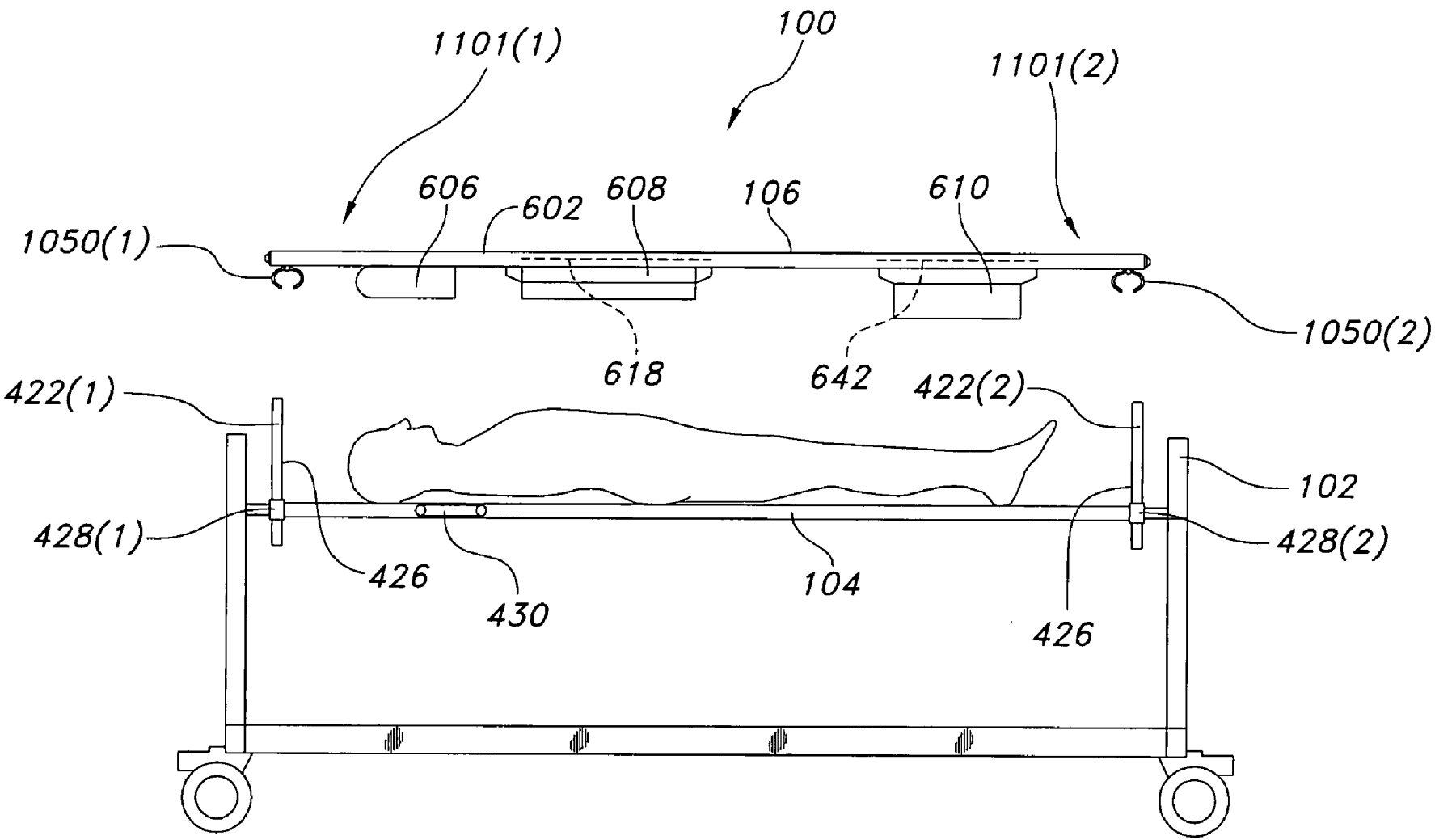
FIG. 11 shows a side view of an exemplary patient transfer system.

FIG. 11 shows a side view of patient transfer system 100. An exemplary method of attaching restraint/support system 106 over a patient in a supine position on platen 104 may be described with reference to FIG. 11.

Initially, the height of U-shaped members 422 are elevated above the front of the patient. For example, turning hand crank 430 in a clockwise or counter-clockwise direction adjusts posts 426 up or down within sleeves 428, hence adjusting the height of U-shaped members 422.

Next, restraint/support system 106 may be lifted and attached to platen 104 via U-shaped members 422. For example, staff members may lift frame 602 by handles 604(1), 604(2) and lower frame 602 until clamps 1050 rest on U-shaped members 422. Clamps 1050 are then secured (engaged) around cross members 424 (FIG. 4) and locked. Once clamps 1050 are locked in concentric fashion around cross members 424 (FIG. 4), restraint/support system 106 is positioned above the supine patient on platen 104. That is, head support member 606, torso support member 608, and leg support member 610 are not in contact with the patient.

Still referring to FIG. 11, now, a staff member may move the position of head support member 606, torso support member 608 and leg support member 610 to align with the head, torso and legs, respectively, of the patient. For example, torso support member 608 may be slid up or down track 618 in a lengthwise direction with respect to the patient to align with the chest of the patient. Leg support member 610 may be slid up or down track 642 in a lengthwise direction with respect to the patient to align with the legs of the patient. It is noted that guides such as lasers (not shown), telescoping guides (not shown) or other devices may be used for aligning and positioning support members 606, 608, 610.

Once support members 606, 608, 610 and the patent are generally aligned with the patient's head, chest, and legs, frame 602 may be lowered onto the patient by lowering restraint/support system 106 using crank 430. For example, U-shaped members 622 are lowered via hand crank 430 or by other means which lowers frame 602 onto the patient. It is also possible adjust head support member 606, torso support member 608 and leg support member 610 vertically by inflating them (if they are inflatable). Depending on the size and shape of the patient, further adjustments may be made to the size and alignment of head support member 606, torso support member 608, and leg support member 610, relative to the patient's head, chest, and legs. Proper alignment ensures the patient is securely restrained and supported when platen 104 is rotated 180 degrees.

Next, platen 104 is rotated about center axis 506 and the patient is turned from the supine position to the prone position. For example, locking mechanism (such as a pin 508 see FIG. 5) is released allowing platen 104 to rotate freely from a fixed horizontal position. Rotation of platen 104 may then occur manually by pushing/pulling on handles 416 (see FIG. 4) or through hand crank system (not shown) or automated system (not shown). Generally, the patient is rotated 180 degrees from the supine to the prone position adjacent to operating table 302 (FIG. 3). Then patient transfer system 100 is then moved and aligned directly over the operating table 302 as shown in FIG. 3. Chassis 102 and/or platen 104 are height adjustable, which enables the patient to be lowered to a point where restraint/support system 106 rests on operating table 302 (FIG. 3).

An interlock system (not shown) may also be implemented that permits rotation only when the restraint/support system 106 is properly engaged over the patient. This ensures that the patient is not rotated about an axis with an improperly installed restraint/support system 106.

Once the patient is rotated 180 degrees and lowered onto the surface of the operating table, clamps 1050 (see FIGS. 10, 11, and 12) may be unlocked and opened from grasping U-shaped members 622 (FIGS. 6A, 11), thereby releasing restraint/support system 106 and allowing the patient to be deposited onto the surface of an operating table. For example, FIG. 12 shows a side view a patient disposed in a prone position on an operating table 302 with restraint/support system 106 residing underneath the patient, elevating and supporting the head, torso, and the legs of the patient, respectively. In the exemplary illustration, torso support member 608 is arched causing the spine of the patient to assume a convex arched shape. Upon completion of an operation, torso support member 608 may be lowered. For example, if torso support member 608 includes inflatable chambers 904 (FIG. 9), chambers 904 may be deflated. A hand crank system 960 may also be used to reduce the tension on a mechanical spring (or screw 908) associated with a Wilson Frame styled torso support member such as described above with reference to FIG. 9. It should be pointed out again, that while torso support member 608 is shown to assume a convex shape in FIG. 12, it may not be necessary in certain operations or be a feature of patient transfer system 100.

Figure 13:
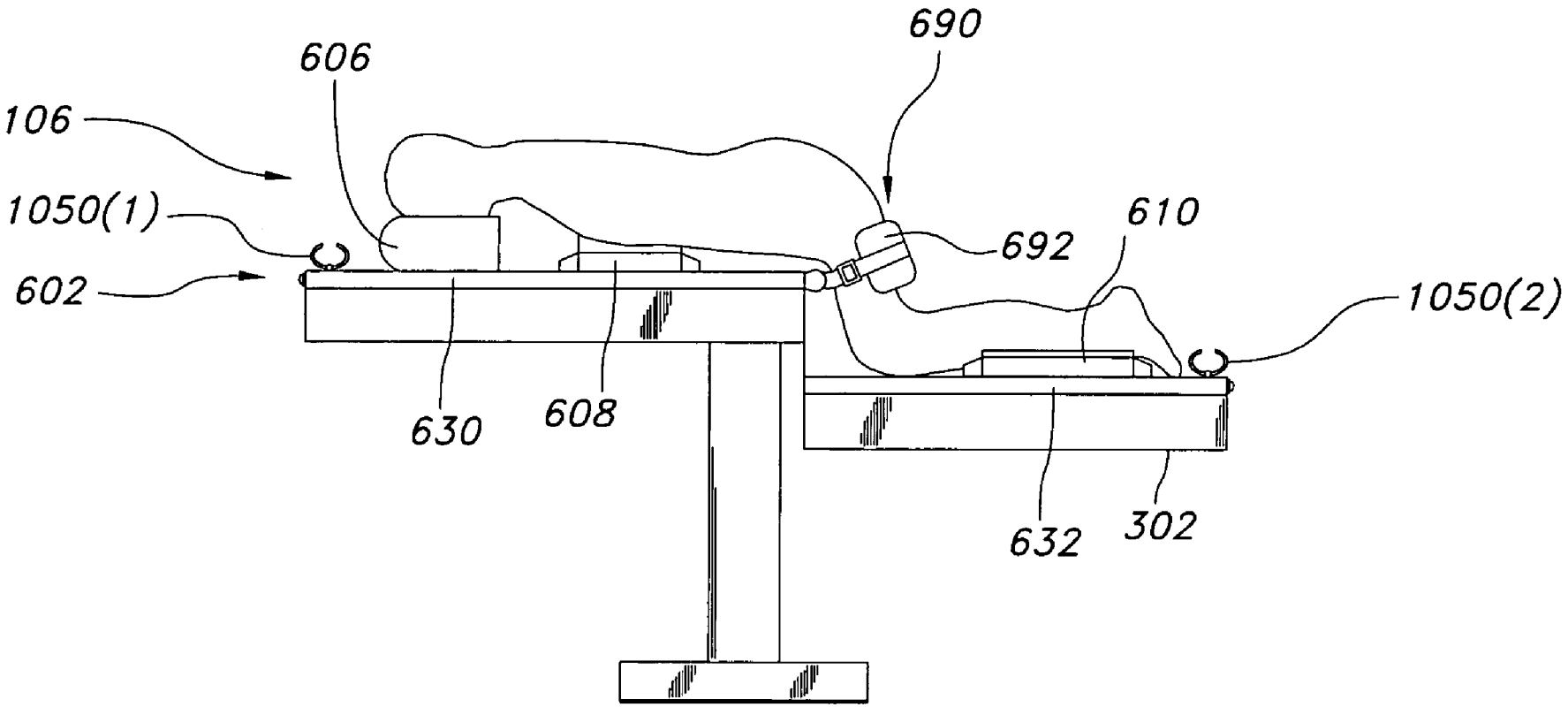
FIG. 13 shows a side view of a patient in a knee-chest position with the restraint/support system residing underneath the patient and on the surface of the operating table.

It should also be appreciated by those skilled in art, that the patient could also be placed into a knee-chest position by disconnecting subsection 632 (see FIG. 6B) of frame 602 from subsection 630, dropping the lower half of operating table 302, and then connecting the buttocks support member 690 to frame 602. For example, FIG. 13 shows a side view of a patient on an operating table in a knee-chest position with the restraint/support system 106 residing underneath the patient. In this example, torso support member 608 is shorter than shown in FIG. 9 and does not generally assume a convex shape. With reference to FIG. 13, upon completion of a medical procedure, operating table 302 is returned to its original position. Accordingly, buttocks support member 690 is disconnected from subsection 630 (FIG. 6C) and subsection 632 is reattached to subsection 630 (FIG. 6B).

Now, referring to FIG. 3, chassis 102 is then moved and aligned directly over the operating table 302. Height adjustable chassis 102 and/or platen 104 is lowered toward the surface of operating table 302 allowing U-shaped members 422 (FIGS. 4 and 11) to align and engage clamps 1050 (FIG. 11). Once they are aligned and engaged, clamps 1050 are securely locked (not shown) around U-shaped members 422 (FIGS. 4, 6A, 11), and the patient may be lifted off operating table 302 and rotated back to the supine position. Then, clamps 1050 may be unlocked again, and frame 602 of restraint/support system 106 may be lifted off the patient.

It is noted that frame 602 may attach and detach from patient transfer system 100 through the use of male guide members (not shown) at the ends of frame 602 for engaging/disengaging slots or apertures (not shown) in platen 104. In such an embodiment, frame 602 may slide down onto the patient. It is also noted that platen 104 may be height adjustable relative to restraint/support system 106, instead of lowering patient restraint/support system 106 on to the patient as described above.

It is additionally noted that the patient may be secured to platen 104 without the use of a frame 602 such as with a harnesses connected around the patient and connected to platen 104. Restraint/support system 106 may also be implemented with other suitable restraint/support members and different contoured padding than described above. For example, torso support member 608 and leg support member 610 may be joined in an articulated fashion.

It should also be appreciated that patient transfer system 100 may operate under the control of automated or semi-automated system. Such a system would include a control system (not shown) with algorithms stored therein which control the operation of the machinery to perform each operation such as rotation. Such a system may also include monitors, for example, pressure monitors for monitoring pressure of padding applied to the patient when the restraint/support system is secured over the patient. This will ensure that proper pressure is applied to the patient by head support member 606, torso support member 608 and leg support member 610, when restraint/support system 106 is attached to platen 104.

CONCLUSION

The described embodiments are to be considered in all respects only as exemplary and not restrictive. The scope of the invention is, therefore, indicated by the subjoined claims rather by the foregoing description. All changes which come within the meaning and range of equivalency of the claims are to be embraced within their scope.

I claim:

1. A patient transfer system for transferring a patient to an operating table in a prone position from a supine position, and vice versa, the patient transfer system comprising:

a chassis having wheels secured thereto for movement of the chassis across a floor, the chassis configured to straddle a base of the operating table;

a platen, coupled to the chassis, rotatable about an axis and adapted to receive a patient in a supine position and turn the patient from a supine position to a prone position, and vice versa;

a frame, positioned in parallel with and spaced apart from the platen, the frame releasably attached to at least one of the platen and the chassis; and a restraint/support system, comprising a first segment, a second segment, and a third segment, wherein while the frame is attached to the at least one of the platen and the chassis and the patient is rotated from the supine position to the prone position, and vice versa, the first segment, the second segment and the third segment are configured to hold stationary the head, torso and legs of the patient respectively, and wherein while the frame is detached from the at least one of the platen and the chassis and the patient is deposited on the operating table in a prone position, the first segment, the second segment, and the third segment are configured to reside underneath the patient, to elevate and to support the head torso, and the legs of the patient, respectively.

2. The patient transfer system as recited in claim 1, wherein the restraint/support system is interposed between the frame and the front of a patient.

3. The patient transfer system as recited in claim 1, wherein the first segment comprises padding configured to abut and support outer portions of a patient's head.

4. The patient transfer system as recited in claim 1, wherein the second segment includes padding slideably connected to the frame, the padding configured to fit against a patient's chest.

5. The patient transfer system as recited in claim 1, wherein the third segment includes padding slideably connected to the frame, the padding configured to fit against a patient's legs.

6. The patient transfer system as recited in claim 1, wherein the frame comprises a tubing construction having at least two portions separable from each other corresponding to a point where the operating table is adjustable into two different surface levels.

7. The patient transfer system as recited in claim 1, wherein the second segment comprises at least one inflation bladder configured to be secured between a patient's body and at least one of the frame and a patient supporting surface associated with the operating table, wherein the inflation bladder is inflated with at least one of pressurized air and pressurized fluid.

8. The patient transfer system as recited in claim 1, further comprising cuffs attached to opposite sides of the second segment, the cuffs positioned to secure the arms of a patient when the patient is rotated from the supine position to the prone position, and vice versa.

9. A patient transfer system for transferring a patient to an operating table in a prone position from a supine position, and vice versa, the patient transfer system comprising:

a chassis having wheels secured thereto for movement of the chassis across a floor;

a platen, coupled to the chassis, rotatable about an axis and adapted to receive a patient in a supine position and rotate the patient from a supine position to a prone position, and vice versa; and a restraint/support system adapted to hold the head, torso, and legs of the patient stationary on the platen while the patient is rotated from the supine position to the prone position, and vice versa, the restraint/support system also configured to support the head, torso, and legs of the patient while the patient is deposited on the operating table in a prone position, the restraint/support system further comprising a frame releasably attached to at least one of the platen and the chassis, the frame spaced apart from the platen in a substantially parallel position relative to the platen when attached to at least one of the platen and the chassis.

10. The patient transfer system as recited in claim 9, wherein the restraint/support system further comprises a head support member comprising padding configured to abut and support outer portions of a patient's head.

11. The patient transfer system as recited in claim 9, wherein the restraint/support system further comprises a torso support member including padding slideably connected to the frame, the padding configured to fit, in at least in part, against a patient's chest.

12. The patient transfer system as recited in claim 9, wherein the restraint/support system further comprises a leg support member including padding slideably connected to the frame, the padding configured to fit against a patient's legs.

13. The patient transfer system as recited in claim 9, wherein the restraint/support system further comprises support members disposed between the frame and the patient.

14. The patient transfer system as recited in claim 9, wherein the restraint/support system further comprises a chest support member having one of at least one inflation bladder and a contoured support member configured to be secured between a patient's body and at least one of the frame and a patient supporting surface associated with the operating table, wherein the at least one inflation bladder is inflated with at least one of pressurized air and pressurized fluid.

15. A patient transfer system, comprising:

a gurney for transporting a patient to an operating table, rotating the patient from a supine position to a prone position, aligning the patient with the operating table, lowering the patient to the operating table, depositing the patient on the operating table, recovering the patient from the operating table including raising the patient from the operating table, rotating the patient back to the supine position from the prone position, and transporting the patient away from the operating table; the gurney comprising:

(a) a chassis having wheels secured thereto for movement of the chassis across a floor;

(b) a platen, coupled to the chassis, rotatable about an axis and adapted to receive a patient in a supine position and turn the patient from a supine position to a prone position, and vice versa, the platen being adjustable in height relative to the floor; and (c) a restraint/support system, adapted to secure the patient to the platen while the patient is rotated from the supine position to a prone position, and vice versa, the restraint/support system having support members wherein while the patient is deposited on the operating table in a prone position, the support members are configured to reside underneath the patient and elevate and support portions of the head, torso, and legs of the patient relative to a surface of the operating table, the patient transfer system further comprising a frame, spaced apart from the platen in a substantially parallel position relative to the platen, the frame releasably attached to at least one of the platen and the chassis.

16. The patient transfer system as recited in claim 15, wherein the support members comprise a first segment, a second segment, and a third segment, wherein when the frame is attached to the at least one of the platen and the chassis and the patient is rotated from the supine position to the prone position, and vice versa, the first segment, the second segment, and the third segment are configured to hold the head, torso, and legs of the patient, respectively, stationary.

17. The patient transfer system as recited in claim 15, wherein the support members comprise a first segment, a second segment, and a third segment, wherein when the frame is detached from the at least one of the platen and the chassis and the patient is deposited on the operating table in a prone position, the first segment, the second segment, and the third segment are configured to reside underneath the patient, to elevate and to support the head, torso, and legs, of the patient, respectively.

18. The patient transfer system as recited in claim 17, further comprising cuffs attached to opposite sides of the second segment, the cuffs positioned to secure the arms of a patient when the patient is rotated from the supine position to the prone position, and vice versa.

19. The patient transfer system as recited in claim 17, wherein the second segment comprises at least one inflation bladder configured to be secured between a patient's body and at least one of the frame and a patient supporting surface associated with the operating table, wherein the inflation bladder is inflated with at least one of pressurized air and pressurized fluid.

20. The patient transfer system as recited in claim 15, wherein the frame comprises a tubing construction having two subsections separable from each other.

21. The patient transfer system as recited in claim 15, wherein the frame comprises a tubing construction having two separable subsections, and wherein the patient transfer system further comprises a buttocks support member removeably attached to at least one of the two separable subsections, whereby the buttocks support member wraps around and secures the patient to the at least one of the two separable subsections while the patient is in a knee-to-chest position, and the buttocks support member is engaged with the at least one of the two separable subsections.

* * * * *

UNITED STATES PATENT AND TRADEMARK OFFICE

CERTIFICATE OF CORRECTION

PATENT NO. : 7,197,778 B2
APPLICATION NO. : 11/294608
DATED : April 3, 2007
INVENTOR(S) : Lewis Sharps It is certified that error appears in the above-identified patent and that said Letters Patent is hereby corrected as shown below:

Please correct the following typographical errors to read as follows:

In column 3, on lines 35 and 36, delete the number “6” on line 35 and delete the number “7” on line 36;
In column 6, on line 15, delete the number “11”; and
In column 7, on line 16, delete the number “11”.

Signed and Sealed this

Eighteenth Day of March, 2008

JON W. DUDAS
*Director of the United States Patent and Trademark Office*